United States Patent [19]

Ekholm, Jr.

[11] 4,340,152

[45] Jul. 20, 1982

[54] METHOD AND APPARATUS FOR REMOVING THE CONTENTS OF FLEXIBLE OR COLLAPSIBLE CONTAINERS

[75] Inventor: Carl R. Ekholm, Jr., Elgin, Ill.

[73] Assignee: Baxter Travenol Laboratories, Inc., Deerfield, Ill.

[21] Appl. No.: 176,548

[22] Filed: Aug. 8, 1980

[51] Int. Cl.[3] ..... B67B 7/00

[52] U.S. Cl. ..... 222/1; 222/87; 222/103; 222/135; 222/146 H; 100/144; 83/435.2; 221/81

[58] Field of Search ..... 222/1, 80, 82, 87, 94, 222/96, 101–103, 144, 135, 138, 146 H; 100/151, 144; 99/443 C, 483, 349; 83/435.2; 221/81

[56] References Cited

U.S. PATENT DOCUMENTS

| | | | |
|---|---|---|---|
| 1,469,398 | 10/1923 | Street | 222/87 |
| 2,674,392 | 4/1954 | Kunz | 222/103 |
| 3,194,452 | 7/1965 | Sanderford | 222/102 |
| 3,511,665 | 5/1970 | Simjian | 222/82 |
| 3,893,590 | 7/1975 | Paroussiadis | 222/103 |
| 3,957,168 | 5/1976 | Shine | 215/1 C |
| 3,961,727 | 6/1976 | Spears | 222/103 |
| 4,125,206 | 11/1978 | Wilson | 222/101 |
| 4,172,536 | 10/1979 | Holt | 222/103 |

FOREIGN PATENT DOCUMENTS

| | | |
|---|---|---|
| 2322053 | 8/1976 | France . |
| 1516470 | 7/1978 | United Kingdom . |

*Primary Examiner*—H. Grant Skaggs
*Attorney, Agent, or Firm*—Paul C. Flattery; John A. Caruso; Gary W. McFarron

[57] ABSTRACT

Apparatus and method are disclosed for quickly, efficiently and with minimum human contact removing the contents of flexible or collapsible containers, for example, frozen blood from the plastic pouches in which it is collected from human donors. The container is positioned and retained between a pair of plates which are relatively movable to compress the container to discharge the contents. The plates are preferably mounted on a continuous conveyor for automatically moving the container from a loading station where the container is inserted between the plates, to an opening area where a portion of the container is removed to provide access to the contents, and from there to a compression position where the plates are forced together to discharge the contents from the container through the access opening. For frozen contents, the plates and container may also pass through a thawing area where the container is heated sufficiently to free it from the frozen contents.

26 Claims, 10 Drawing Figures

METHOD AND APPARATUS FOR REMOVING THE CONTENTS OF FLEXIBLE OR COLLAPSIBLE CONTAINERS

The present invention relates, in general, to method and apparatus for removing the contents of flexible or compressible containers. More particularly, the present invention relates to method and apparatus for cleanly, efficiently and with minimum human contact removing frozen whole blood or the like from plastic pouches in which it is collected.

Although much of the blood collected from human donors at hospitals, donor centers, blood banks and the like is later used as direct blood replacement in surgical or critical-care patients, large quantities of the blood collected at these facilities are processed (called blood fractionation) to break the blood down into its various components, such as plasma, red blood cells or platelets. This permits the limited quantity blood available to be used more efficiently, for example, in treating a patient needing only one of blood components.

Usually blood is collected at the donor centers in small sterile plastic pouches or containers, usually a pint or less in capacity, and stored by freezing until a sufficient quantity of blood is collected for processing. After enough frozen whole blood has accumulated for a batch, the frozen slugs of blood are removed from the pouches and processed through the necessary equipment.

It is important that the frozen blood be quickly removed from pouches after they are taken from cold storage, since premature thawing permits valuable precipitate, which is produced by the freezing process, to go back into solution thus reducing the processing yield. Because the pouch is usually of one-piece sealed construction, removal of the frozen slug requires opening the container, usually by cutting or slicing off one end of the container, which has heretofore been a manual operation. The drawbacks with manually cutting or removing a portion of the container are several. Firstly, it tends to be a slow operation, which permits excessive thawing of the frozen blood, and reduces the yield of the processing operation. Secondly, manual cutting may create unwanted plastic particulate or slivers which find their way into the blood fractionating process. In addition, the manual operation exposes the blood indirectly to human contact, which can cause contamination of the blood being processed and in the worst case, result in an entire batch being contaminated and disgarded.

Accordingly, it is a general object of the present invention to provide method and apparatus for removing the contents of flexible collapsible containers, such as blood pouches or bags, which do not suffer from the drawbacks discussed above.

It is a further object of the present invention to provide method and apparatus for removal of frozen whole blood from the plastic pouches in which it is stored without generating plastic particulate or foreign matter during the opening procedure and while minimizing human contact with the whole blood.

It is another object of the present invention to provide such method and apparatus which removes the frozen blood quickly and efficiently to minimize excess thawing.

These and other objects of the present invention are set forth in the following detailed description of the attached drawings, of which:

As shown in the attached drawings, the present invention is generally embodied in method and apparatus 10 for removing the contents of a compressible pouch or container 12 by compressing the pouch between a pair of relatively movable clamping plates 14, 16 so as to force the contents through an open end of the pouch or container.

Figure 2:
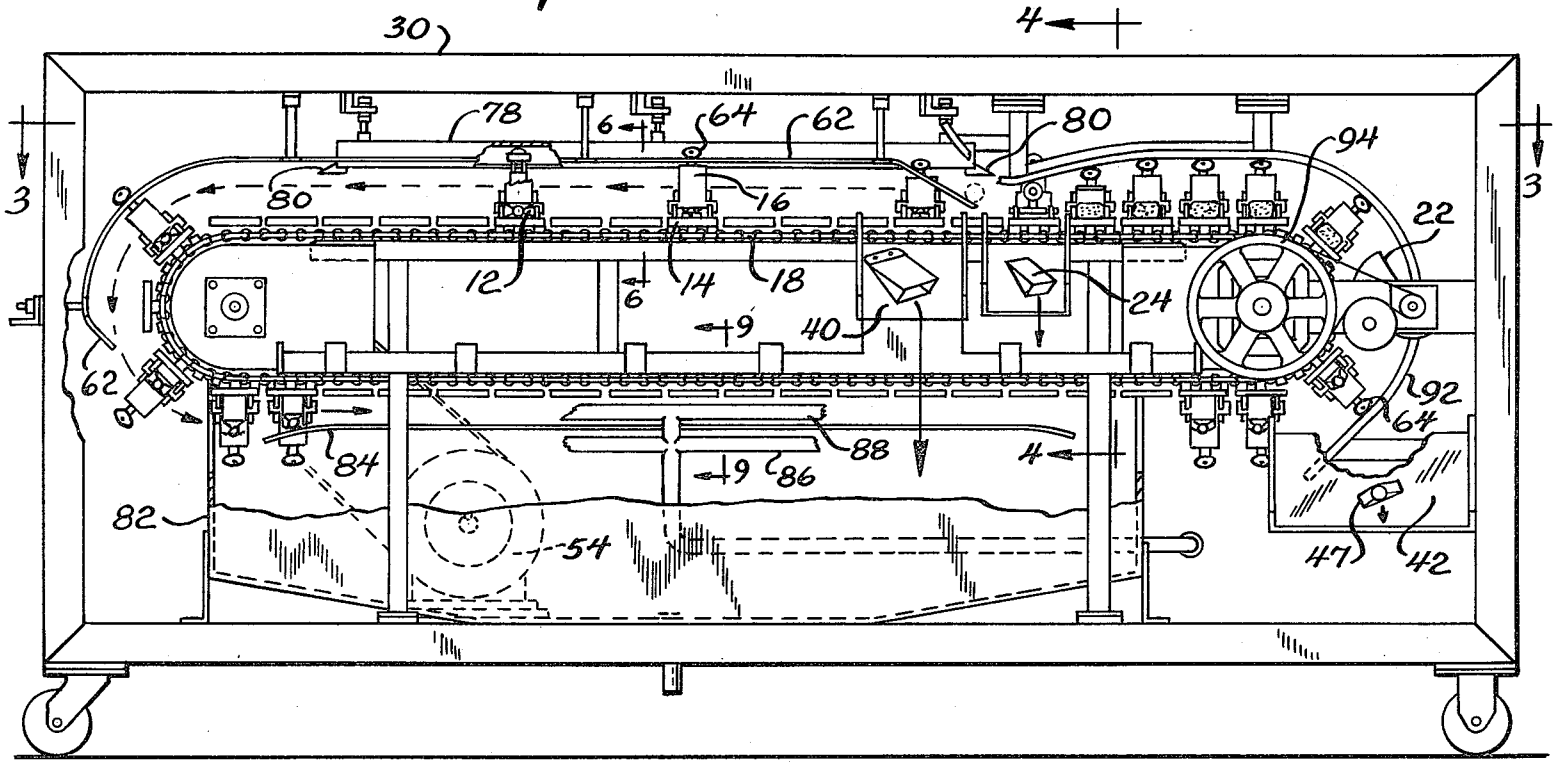
FIG. 2 is a front elevational view of the apparatus of FIG. 1, with the front panel moved and other parts of the apparatus broken away to show various features of the present invention.

In accordance with various aspects of the present invention, and referring generally to FIG. 2, the frozen blood of many plastic pouches 12 may be quickly and efficiently removed with a minimum of human contact, by employing apparatus 10 in which a series of pairs of clamping plates 14 and 16 are mounted on a continuous conveyor 18 for automatic and continuous movement of the pouches from a loading position in which the plates are spaced apart for receiving a pouch 12 of frozen blood therebetween, to a thawing area where the container is briefly warmed. e.g., by water spray (FIG. 9), to free the container from the frozen contents; from the thawing area to a cutting station where the end of the container protruding from between the plates is sliced away by a rotary knife 22 (FIG. 5), thus opening the container for discharge of the frozen slug as the plates pass to a compression position where the plates are forced together, discharging the frozen slug 24 from the open end of the pouch.

Figure 6:
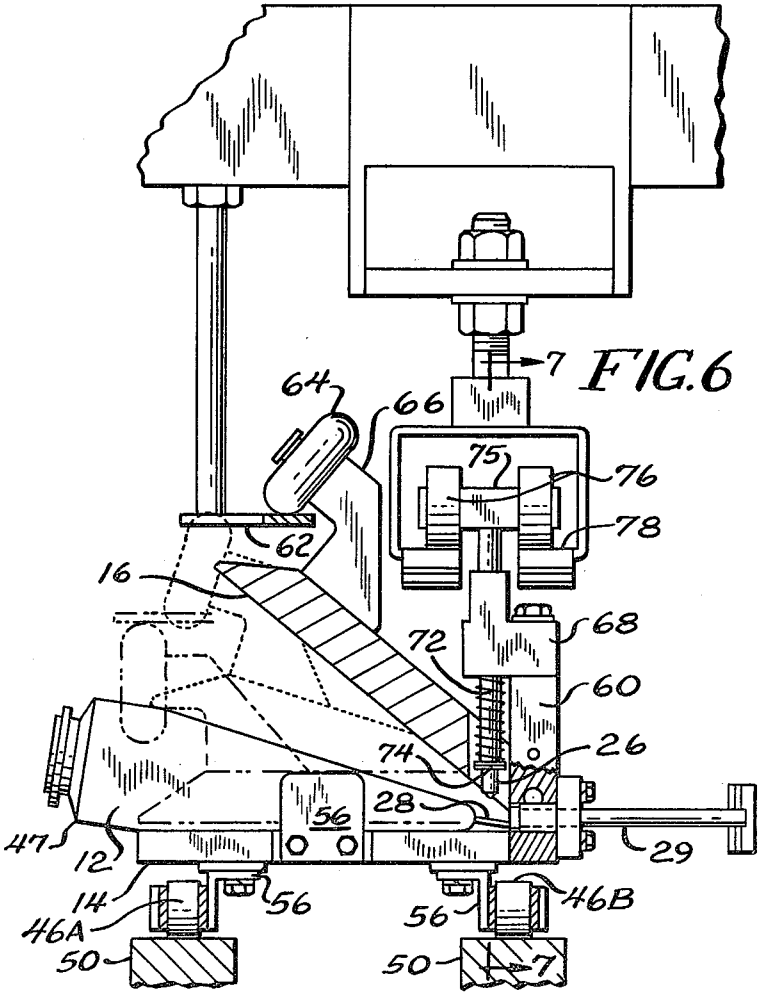
FIG. 6 is a vertical sectional view taken along line 6—6 of FIG. 2, showing various positions of the clamping plates employed in the present apparatus to compress the container to discharge the contents.
Figure 7:
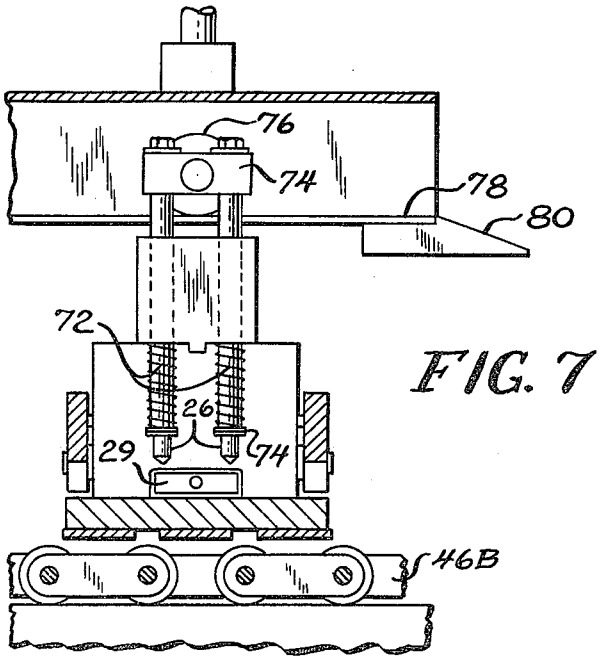
FIG. 7 is a vertical sectional view taken along line 7—7 of FIG. 6.

Referring briefly to FIGS. 6 and 7, retention means, preferably movable pins 26 which engage against the pouch tail flap 28, hold the pouch between the plates during movement between the various processing stations and during the compression of the plates. After the frozen slug 24 is discharged, the pins 26 retract, and the empty container is ejected by a ram 29 which sweeps the space between the plates to dislodge and eject the container before a new one is inserted.

Figure 1A:
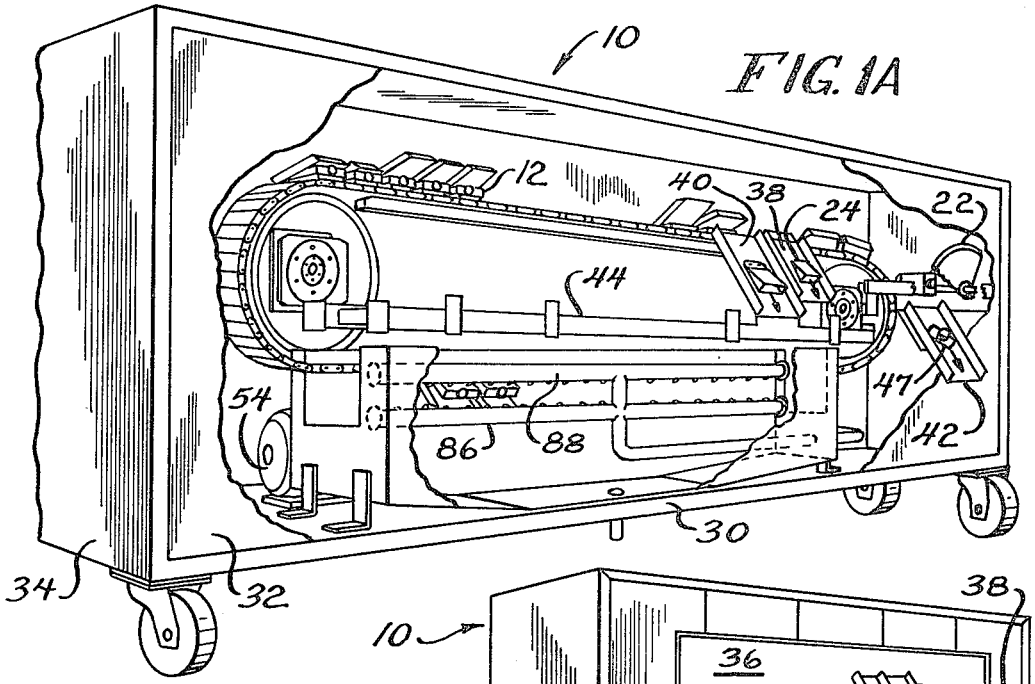
FIG. 1A is a perspective view of the apparatus of FIG. 1, with portions of the front panel removed and other parts of the apparatus broken away to show various features of the apparatus.
Figure 1:
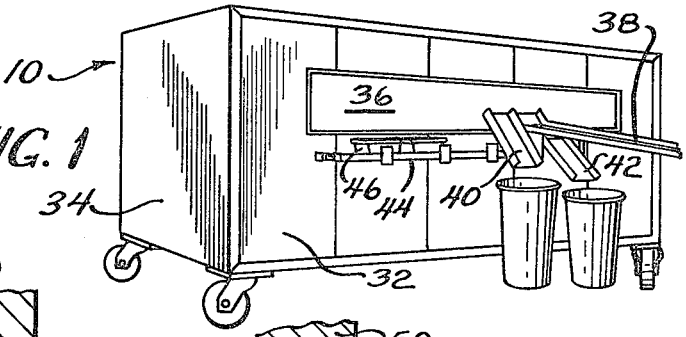
FIG. 1 is a perspective view of the overall apparatus embodying the present invention.

Turning now to a more detailed description of the attached drawings, which show the preferred embodiment of the present invention for the purpose of illustration and not limitation, and referring to FIGS. 1, 1A and 2, the apparatus 10 has an elongated steel or aluminum frame 30 covered by panels 32, 34 to enclose the moving parts of the processing apparatus. The front panel 32 has a long narrow access opening 36 adjacent to the upper length of conveyor 18 for loading the conveyor with frozen pouches and for removing frozen slugs of blood and empty containers via chutes 38 and 40 respectively. The container end portions removed during the cutting operation are also discharged through the access opening 36, typically by a chute 42. A shelf or rack 44 is attached below the access opening 36 in the front panel 32 so that a large supply of frozen pouches in trays 46 are available for loading into the conveyor, which is the only manual operation required in the present invention.

The blood containers or pouches 12, used in the present invention are usually made of a thin flexible plastic material such as polyethylene or polyvinylchloride, and may be of a variety of shapes or sizes. Preferably, however, to accomodate the particular clamping, retaining and cutting operations of the present invention, the pouch 12 (referring to FIGS. 6 and 9) preferably tapers from a relatively wide shoulder portion 47 that extend beyond the edge of the plates 14 and 16 to the flat tail flap portion 28. The shoulder typically includes an access port by which blood was received into the container from the donor. The container is described in more detail in U.S. patent application Ser. No. 018,499 filed Mar. 8, 1979.

Figure 3:
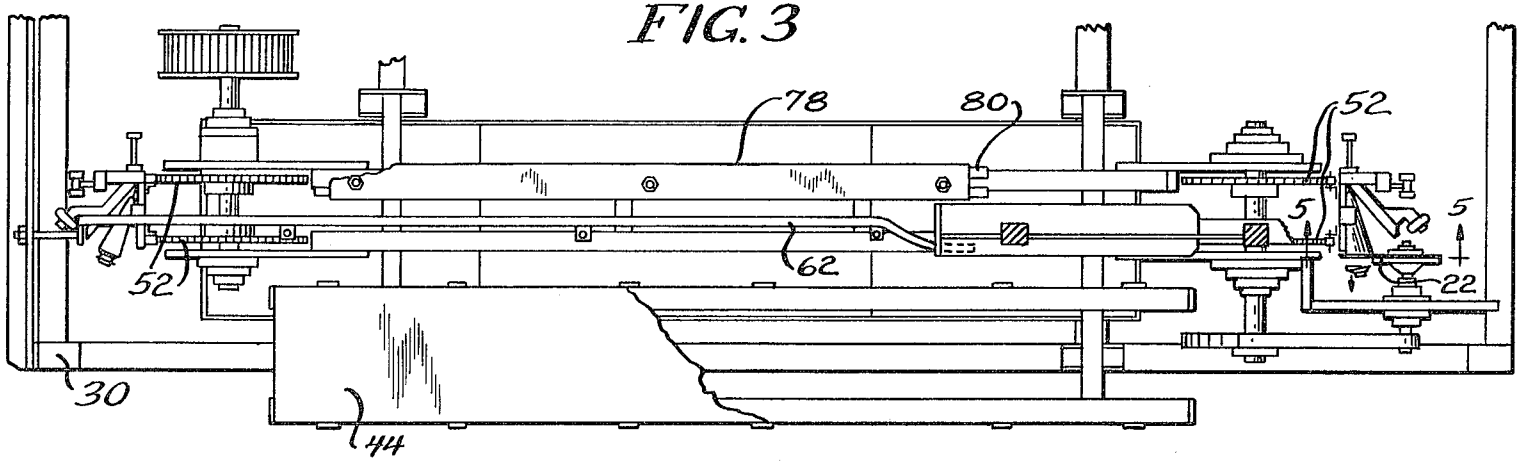
FIG. 3 is a top plan view of the apparatus of FIG. 1, with the top panel removed, and showing in particular the drive machanism, frame, and guide rails of the apparatus embodying the present invention.
Figure 4:
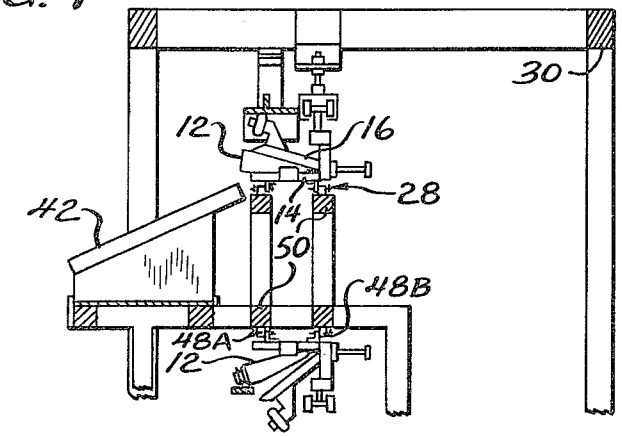
FIG. 4 is a vertical sectional view taken along line 4—4 of FIG. 2.

As described briefly earlier, the pouch 12 is inserted between one of a series of relatively movable plates 14 and 16 which are mounted on a continuous conveyor 28. Referring briefly to FIGS. 4, 6, and 7, the conveyor 28 is made up of a pair of spaced-apart continuous chains 48A and 48B which are supported by and move along horizontal support rails 50. The chains are driven at each end by sprockets 52 (FIG. 3), at least one of which is in turn driven by electric motor 54 (FIG. 2).

As shown in FIG. 6, the plates 14 and 16 are mounted atop the conveyor chains 48A 48B, with the lower, horizontal plate 14 being secured to each chain by under-brackets 56. The lower plate is generally flat and dimensioned to receive the pouch 12 between side rails or guides 56 attached to the side edges of the plate. In addition, the length of the plate is preferably sufficient to support the pouch, but short enough to allow the wide shoulder portion of the pouch, which is removed later during the cutting operation, to extend beyond and to overhang the end edge of the plate.

The upper plate 16, which is of similar size and shape as the lower plate 14, is mounted for pivotal movement with respect to the lower plate by hinged connection between extensions 58 at one end of the upper plate and a rearward upright support member 60 attached to the back edge of the lower plate 14. The dotted lines in FIG. 6 shows various pivotal positions the top plate 16 passes through as it moves between an open position (solid lines) where the plates are spaced apart, and a closed position where the pouch 12 is flattened between them. The up and down pivoting of the plate 16 is controlled by cam guide track 62 which engages roller 64 mounted on extension arm 66 of the upper plate. This will be described in more detail later when the operation of the apparatus 10 is discussed.

Figure 8:
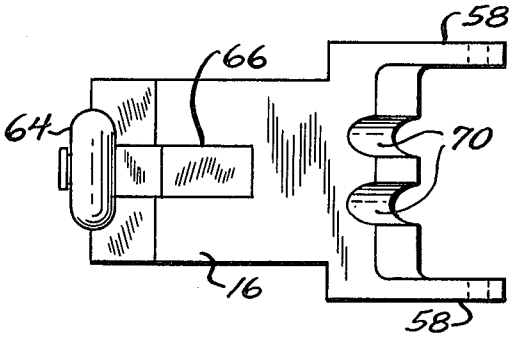
FIG. 8 is a top plan view of the movable clamping plate shown in FIG. 6.

The retention pins 26 are slidably mounted in a guide bracket 68 bolted atop the rearward support member 60 and are movable vertically to engage the container or pouch through access slots 70 (FIG. 8) in the cut-out portion of the upper plate 16. Springs 72 between the guide bracket 68 and retainer 74 normally bias each pin downward against the lower plate. Although not required, the lower plate could be drilled to allow the pins actually to pierce the tail flap 28.

To control vertical movement of the pins 26, a yoke 75 is attached to the upper end of the pins, and carries a pair of rollers 76 which are positioned to engage a control track 78 along the conveyor, which raises the pins to permit addition of new pouches or ejection of empty pouches.

To dislodge empty containers from between the plates 14 and 16 after removal of the frozen slug of whole blood 24, the ram 29 is positioned within an opening in the upright rearward member 60 for movement into the space between the plates, to dislodge the empty container and shove it forward from between the plates. The ram is preferrably spring loaded in a retracted position, and forced forward by either a control track behind the conveyor or by impact from a piston-cylinder device (not shown) which is located behind the conveyor. Referring to FIG. 7, the ram has a wide head closely adjacent to the surface of the lower plate 14, to provide more positive engagement with the empty containers so as to better assure dislodging the container from between the plates.

The remaining features of the present invention will be described in terms of the actual processing steps which take place in removing frozen blood from a pouch 12. In the loading position, the plates 14 and 16 are spaced apart, with the roller 64 on the upper plate carried atop cam guide rail 62 which keeps the plates in an open position. The rollers 76 which control the movement of the retention pins 26 are in a raised position within control track 78, lifting the retention pins upwardly, out of the way for loading containers. The pouch 12 is inserted between the plates 14 and 16, tail flap first.

As the conveyor (referring to FIGS. 1A and 2) moves counterclockwise, the rollers 76 which control the retention pins 26 roll down incline 80 at the end of the control track 78 before the plates start to move around the left end of the conveyor. This releases the spring biased retention pins to engage against the pouch tail flap 28 to hold it in position. The pins remain in this position until the pouch is emptied and ready to be ejected. As the pair of plates 14 and 16 proceed around the left sprocket, gravity acts to keep the top plate 16 spaced from the bottom plate 14, and the cam guide track 62 also terminates.

Figure 9:
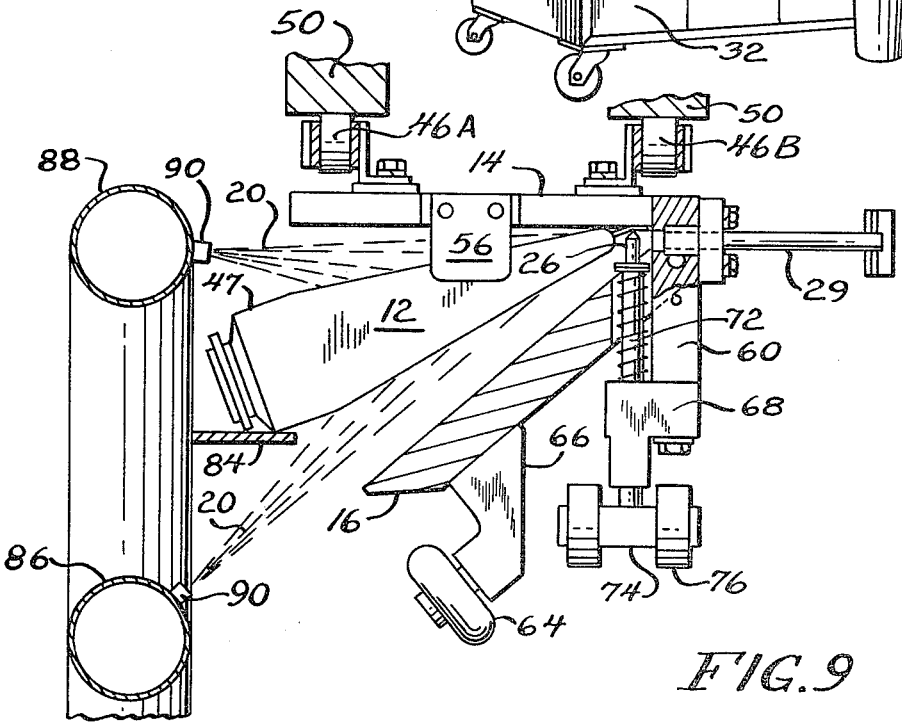
FIG. 9 is a vertical sectional view taken along line 9—9 of FIG. 2, illustrating passage of a frozen blood container through a thaw tank for freezing the container from the frozen slug of blood therewithin.

Along the underside of the conveyor, the pair of plates and pouch enter a thaw tank 82. The thaw tank is generally a narrow elongated trough mounted below the conveyor, where the pouch is warmed by a water spray to cause release of the pouch from the frozen slug therewithin. Upon entry of the pouch clamping unit into the tank, the broad shoulder 47 of the pouch is engaged by a lifting rail 84 which raises the pouch away from contact with the plate 16, so that water may be sprayed to contact both sides of the pouch. As shown in FIG. 9, which best depicts the spraying operation, two water lines 86 and 88 are horizontally positioned along the length of the thaw tank and provided with a series of nozzels 90 adapted to spray the top side and underside of the pouch 12, as it moves through the tank. The water temperature for the thawing operation may be controlled by intermixing cold and hot water supplies at a wall station or the like. Preferably, the water temperature should be sufficient to free the container from the frozen slug of blood therewithin but not to cause excessive melting of the slug.

Figure 5:
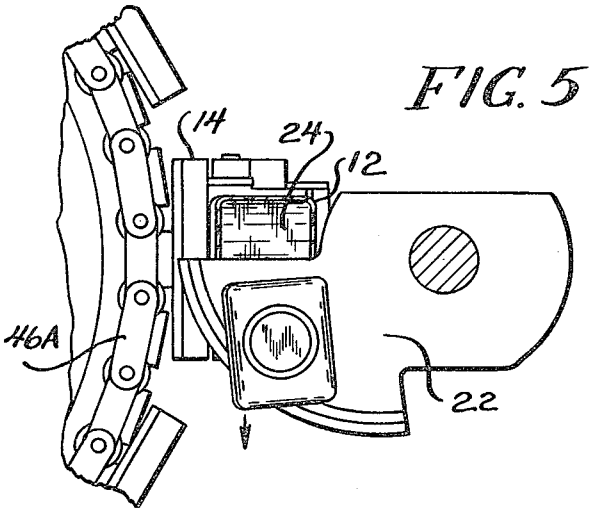
FIG. 5 is a vertical sectional view of the cutting apparatus to open the blood container, taken along line 5—5 of FIG. 3.

Referring back to FIG. 2, as the pouch clamping unit (the pair of plates and the pouch) passes out of the thaw tank, the roller 64 on the upper plate 16 is engaged under another guide rail 92. Eventually, this guide rail forces the top plate downward to compress the pouch. However, prior to that, the pouch passes the cutting operation in which the protruding end of the container is removed. As best seen in FIGS. 2, 3 and 5, the rotating knife blade or scythe 22 mounted at the end of the conveyor slices away the broad shoulder portion 47 of the pouch which protrudes from between the plates. Referring briefly to FIG. 2, the knife blade is driven by a pulley 94 attached to the conveyor drive sprocket. 52. The rotating blade severs the end of the container in one operation without generating excessive plastic particulate or slivers. The end portion of the pouch is discharged down chute 42 which leads to a waste container or the like.

After passing around the right end of the conveyor, the upper plate 16 is forced downwardly against the container by the guide rail 92 which curves toward the upper surface of the conveyor. This action squeezes the frozen slug 24 of whole blood from the open end of the pouch, ejecting it into a chute or a conveyor 38 which conveys the frozen blood to the next processing station.

After ejection of the slug 24, further movement of the conveyor causes rollers 76 which control movement of the retention pins to engage sloping end 80 of the retention pin control track 78. As the rollers ride up the control track, the retention pins are pulled upwardly, against the force of the springs 72, thereby releasing the empty container for discharge. At about the same location, cam guide rail 62 also begins, with a downturned end portion which engages under roller 64 of the upper plate 16, raising the plate and releasing the pouch 12 from compression between the plates.

When the pins are fully retracted, and the top plate 16 is lifted away from the lower plate 14, the ram 29 is activated, either by a control rail behind the conveyor or by an air cylinder or the like, causing the ram to move forward from its retracted position, to shove the empty container from between the plates. The empty container is discharged down chute 40 and into a waste container or the like. After this is completed, the clamping unit is ready for reloading with another container of frozen whole blood.

From the above description it is apparent that with the present invention, large quantities whole blood contained in relatively small volume unit pouches, may be processed quickly, with a minimum elapsed time for thawing, with minimum human contact and in a manner which reduces the possibility of creating undesirable plastic fragments or slivers. Although the present invention has been described in terms of preferred embodiment, the scope of the present invention, as set forth in the attached claims, also includes those equivalent structures, some of which may be immediately apparent upon reading this application, and others of which may be apparent only after some study.

What is claimed is:

1. Apparatus for removing the contents of a compressible container comprising:

compression means including a pair of relatively movable plates defining a container receiving space therebetween;

continuous conveyor means for carrying said plates between first and second locations;

means for moving said plates between an open spaced-apart position at said first location to receive a container, and a closed adjacent position at said second location to compress said container to discharge the contents thereof; and retention means cooperatively associated with said plates to retain a container therebetween during said compression.

2. Apparatus in accordance with claim 1 wherein said plates are pivotally attached at one end.

3. Apparatus in accordance with claim 2 further comprising continuous conveyor means carrying said plates and carrying said retention means, said retention means comprising at least one pin movable for engagement against a portion of the container received between said plates.

4. Apparatus in accordance with claim 3 comprising plate control guide track means disposed to engage at least one of said plates to move it toward and away from the other of said plates as said conveyor means moves, and retention pin control track means disposed along at least a portion of said conveyor means, said retention pin including means to engage said pin control track means to control movement of said pin.

5. Apparatus in accordance with claim 3 wherein the plates are of selected length to permit one end of the container to protrude from therebetween, said apparatus further comprising cutting means positioned relative to said conveyor means to engage and remove a portion of the protruding container end prior to movement of the plates to the closed position.

6. Apparatus in accordance with claim 1 wherein the container has a generally flattened end portion, and said retention means comprise at least one pin adapted for engagement against the flattened end portion.

7. Apparatus in accordance with claim 1 further comprising means for opening one end of the container to permit discharge of the contents upon compression.

8. Apparatus in accordance with claim 7 wherein said plates are of selected length such that at least one end of the container protrudes therefrom, said opening means comprising cutting means adapted to engage and remove at least a portion of said protruding end.

9. Apparatus in accordance with claim 1, wherein said means for moving said plates between an open position and a closed position comprises guide track means engageable with at least one of said plates to move it toward and away from the other of said plates as said plates are carried along by said conveyor means.

10. Apparatus in accordance with claim 1, wherein said retention means is carried by said conveyor means and comprises at least one movable retention pin adapted to engage a portion of the container, said apparatus further comprising a retention pin control track disposed along at least a portion of said conveyor means, said retention pin including means adapted to engage said control track for controlling movement of said pin.

11. Apparatus in accordance with claim 1 comprising container ejection means for ejecting the container from between the plates after the contents are discharged.

12. Apparatus in accordance with claim 1, said ejection means comprising a ram movable to a position between the plates to dislodge and eject the container from between the plates.

13. Apparatus in accordance with claim 1 wherein the container contains a quantity of frozen material, said apparatus further comprising means for thawing said container sufficient to free the container from gripping by the frozen contents.

14. Apparatus for removing frozen whole blood and like contents from flexible plastic containers of the type having means for receiving liquid into the container at one end and a flat tail portion at the other end, said apparatus comprising:

continuous conveyor means;

a pair of pivotally movable plates carried by said conveyor means and adapted to receive a container, tail portion first, therebetween, said plates being of a length to permit the liquid-receiving end of the container to protrude from therebetween, means for moving said plates between an open spaced-apart position to receive the container, and a closed adjacent position to compress said container to discharge the contents thereof as conveyor means moves said plates;

at least one retention pin carried by said conveyor means and adapted to engage the tail portion of the container to retain it between said plates;

means for moving said retention pin between a retracted position for loading of the container between said plates and an extended position to engage the tail portion of the container to retain it between the plates;

opening means adjacent said conveyor means and operable to remove at least a part of the protruding portion prior to movement of said plates to a closed adjacent position.

15. Apparatus in accordance with claim 14 wherein said means for moving said plates between open and closed positions comprises guide track means engageable with at least one of said plates to move said plate toward and away from said other plate as said plates are moved along by said conveyor means.

16. Apparatus in accordance with claim 14 wherein said means to control the movement of said retention pin comprises a retention pin control track positioned along at least a portion of said conveyor, said retention pin including means to engage said tracks for moving said pins between said extended and retracted positions.

17. Apparatus in accordance with claim 14 further comprising ejection means for ejecting the container from between said plates after the frozen blood or the like is discharged.

18. Apparatus accordance with claim 17 wherein said ejection means comprises a ram movable between said plates to dislodge the container.

19. Apparatus in accordance with claim 14 wherein said opening means comprises a cutting blade adjacent said conveyor means and positioned to remove a portion of said protruding container.

20. Apparatus in accordance with claim 14 further comprising thawing means adjacent said conveyor means for warming the container sufficiently to free it from the frozen contents.

21. Apparatus in accordance with claim 20 wherein said thawing means comprises water spray means adjacent said conveyor and adapted to spray said container after insertion between said plates and prior to engagement with said opening means.

22. A method for removing the contents of a compressible container comprising;

positioning said container between a pair of relatively movable plates which define a container receiving space therebetween;

transporting said pair of plates between first and second spaced locations;

moving said plates together during said transporting of said plates between said first and second locations so as to compress the container to discharge the contents of said container through one end thereof;

retaining said container between said plates during compression of the container to prevent accidental dislocation of the container from between said plates.

23. A method in accordance with claim 22 wherein the container includes a flat end portion, said plates are pivotally secured together and the step of inserting said container between said plates comprises inserting the flat end portion towards the pivotal connection, and the step of retaining said container comprises moving at least one pin for engagement against the flat end portion of the container.

24. A method in accordance with claim 22 wherein said plates are of selected length to permit a portion of the container to protrude therefrom, and further comprising the step of removing a portion of said protruding container portion.

25. A method in accordance with claim 22 wherein the contents of said container are frozen, further comprising the step of thawing said container sufficiently to free the container of gripping by the contents.

26. A method in accordance with claim 22 further comprising returning said pair of plates to said first location after discharge of the container contents and moving said plates apart and ejecting the empty container from therebetween during said return movement.

* * * * *